US005359350A

United States Patent [19]

Nakano et al.

[11] Patent Number: 5,359,350

[45] Date of Patent: Oct. 25, 1994

[54] METHOD OF DRIVING INK JET PRINTING HEAD

[75] Inventors: Tomoaki Nakano; Hiromichi Komai, both of Yokohama; Toshitaka Hirata, Tokyo; Toshio Inada, Sagamihara; Masami Kadonaga, Yokohama, all of Japan

[73] Assignee: Ricoh Company, Ltd., Tokyo, Japan

[21] Appl. No.: 897,383

[22] Filed: Jun. 11, 1992

[30] Foreign Application Priority Data

Jun. 14, 1991 [JP] Japan ..... 3-170707

[51] Int. Cl.[5] ..... B41J 2/055

[52] U.S. Cl. ..... 347/10; 347/68; 347/94

[58] Field of Search ..... 346/75, 1.1, 140 R

[56] References Cited

U.S. PATENT DOCUMENTS

| | | | |
|---|---|---|---|
| 4,104,646 | 8/1978 | Fischbeck | 346/140 R |
| 4,437,101 | 3/1984 | Ebi et al. | 346/75 |
| 4,464,668 | 8/1984 | Komai et al. | 346/75 |
| 4,491,851 | 1/1985 | Mizuno et al. | 346/1.1 |
| 4,520,367 | 5/1985 | Ishikawa et al. | 346/75 |
| 4,661,822 | 4/1987 | Hirota et al. | 346/75 |
| 4,897,665 | 1/1990 | Aoki | 346/1.1 |
| 4,990,939 | 2/1991 | Sekiya et al. | 346/140 R |
| 5,146,236 | 9/1992 | Hirata et al. | 346/1.1 |
| 5,172,139 | 12/1992 | Sekiya et al. | 346/140 |
| 5,204,695 | 4/1993 | Tokunaga et al. | 346/140 R |
| 5,260,723 | 11/1993 | Naruse et al. | 346/140 |

FOREIGN PATENT DOCUMENTS

| | | | |
|---|---|---|---|
| 57-59774 | 10/1982 | Japan | B41J 3/04 |
| 59-104950 | 6/1984 | Japan | 346/140 R |
| 59-176060 | 10/1984 | Japan | B41J 3/04 |
| 61-3752 | 1/1986 | Japan | 346/140 R |

*Primary Examiner*—Benjamin R. Fuller
*Assistant Examiner*—John Barlow
*Attorney, Agent, or Firm*—Cooper & Dunham

[57] ABSTRACT

An ink jet printing head driving method includes steps of: applying a voltage falling edge of a first pulse signal to cause a piezoelectric element to contract so that a capacity of a liquid passage is increased so as to supply ink to the liquid passage; applying a voltage rising edge of the first pulse signal to cause the piezoelectric element to expand so that the capacity of the liquid passage is decreased, for discharging an ink droplet through a discharge port, the first pulse signal having a first pulse width and a first peak voltage amplitude; and applying a voltage rising edge of a second pulse signal to the piezoelectric element after a predetermined delay time has elapsed since application of the first pulse signal for discharging the ink droplet, a pulse width of the second pulse signal being smaller than the first pulse width, and a peak voltage amplitude of the second pulse signal being equal to the first peak voltage amplitude.

6 Claims, 5 Drawing Sheets

METHOD OF DRIVING INK JET PRINTING HEAD

BACKGROUND OF THE INVENTION

The present invention generally relates to a liquid jet recording head driving method, and more particularly to a method of driving a drop-on-demand ink jet printing head in which reliability is improved and the print quality is enhanced by means of a simple, low-cost driving circuit for applying a drive signal to the printing head.

There has been known a drop-on-demand ink jet printing head in which an electromechanical transducer is selectively energized to produce ink drops on demand. More specifically, in such a printing head, a drive signal is applied to a piezoelectric element so as to generate a pressure wave in ink within in ink cavity (or, a pressure chamber) by the energized piezoelectric element, and an ink droplet is discharged onto a recording member due to the pressure wave. In the printing head, an ink droplet is discharged via a nozzle at an end portion of the pressure chamber in accordance with the drive signal being applied, the drive signal representing a demand for discharging the ink. It is advantageous that the drive signal is applied to the printing head by means of a simple, low-cost driving circuit. Extensive efforts have been made to improve reliability and enhance the print quality and resolution of the drop-on-demand ink jet printing heads.

Japanese Patent Publication No. 2-24218 (corresponding to Japanese Laid-Open Patent Publication No. 57-59774) discloses a method of driving a drop-on-demand ink jet head. In this driving method, a transducer (a piezoelectric element) is energized by a low-voltage signal so as to achieve a desired ink discharge velocity. A prescribed voltage, being positive with respect to a polarized voltage of the transducer, is applied to charge the transducer so that the capacity of an ink passage in the head is decreased. When a pulse signal having a falling edge the voltage of which gradually falls from the applied voltage is applied to discharge the transducer, the capacity of the ink passage is increased. When a rising edge of the pulse signal the voltage of which sharply rises is then applied, the ink passage capacity is decreased and ink within the ink passage is discharged from a nozzle at an end of the ink passage. However, in this driving method, it is difficult to reduce the magnitude of natural oscillation (or, residual oscillation) of the transducer occurring due to the application of the pulse signal. Thus, a desired print quality of the ink jet printing head cannot be achieved.

Japanese Laid-Open Patent Publication No. 59-176060 discloses a method of driving an ink jet printing head. In this driving method, a drive signal is applied to the piezoelectric element so that ink within the pressure chamber is discharged. Generally, natural oscillation of the piezoelectric element occurs due to application of the drive signal. At least one supplementary signal having a phase different from the phase of the drive signal is subsequently applied so as to improve the repetition frequency characteristic. However, in this driving method, the phase difference between the drive signal and the supplementary signal is not appropriate for reducing the magnitude of the natural oscillation. In other words, a voltage falling edge of the supplementary signal is applied, so as to decrease the pressure of the ink, earlier than a time when the ink is completely discharged due to application of the drive signal. Therefore, it is difficult to reduce the magnitude of the natural oscillation sufficiently, the ink discharge velocity thus having undesired variations and a desired print quality cannot be achieved. In addition, the timing of application of the supplementary signal and the pulse duration thereof are not clearly defined with respect to the drive signal, and therefore the ink jet printing head driving method as mentioned above is not suitable for practical use.

SUMMARY OF THE INVENTION

Accordingly, it is a general object of the present invention to provide an improved method of driving an ink jet printing head in which the above described problems are eliminated.

Another and more specific object of the present invention is to provide an ink jet printing head driving method which allows a stable ink discharging condition and remarkably reduces variations of ink discharging velocity by positively reducing the magnitude of the natural oscillation occurring to the printing head. The above mentioned object of the present invention is achieved by an ink jet printing head driving method which comprises the steps of providing an ink jet printing head including a plurality of transversely spaced parallel liquid passages having a plurality of discharge ports for discharging ink therethrough, an ink supplying member for supplying ink to each of the liquid passages, and a piezoelectric member associated with each of the discharge ports for discharging ink when an associated piezoelectric element is driven, a prescribed source voltage being constantly applied to the piezoelectric member to maintain a capacity of each of the liquid passages at a predetermined level; applying a voltage falling edge of a first pulse signal to cause the associated piezoelectric element to vertically contract so that a capacity of a corresponding liquid passage is increased from the predetermined level so as to supply ink from the ink supplying member to the corresponding liquid passage; applying a voltage rising edge of the first pulse signal to cause the associated piezoelectric element to vertically expand so that the capacity of the corresponding liquid passage is decreased for discharging an ink droplet through a corresponding discharge port, the first pulse signal having a first pulse width between the voltage falling edge and the voltage rising edge and having a first peak voltage amplitude, and applying a voltage rising edge of a second pulse signal to the associated piezoelectric element after a predetermined delay time has elapsed since application of the voltage rising edge of the first pulse signal for discharging the ink droplet, a pulse width of the second pulse signal between a voltage falling edge thereof and the voltage rising edge being smaller than the first pulse width, and a peak voltage amplitude of the second pulse signal being equal to the first peak voltage amplitude. According to the present invention, it is possible to remarkably reduce variations of ink discharge velocity and prevent undesired ink droplets from being discharged. Also, it is possible to effectively eliminate the residual oscillation of the piezoelectric element due to application of the first pulse signal to the printing head. The pulse width of the second pulse signal can be easily changed into a value smaller than that of the first pulse signal by means of the drive signal generating circuit in which a suitable timing control is performed. Also, the peak voltage amplitude of the second pulse signal can be easily changed with no great change of the residual oscillation amplitude.

Other objects and further features of the present invention will become apparent from the following detailed description when read in conjunction with the accompanying drawings.

DESCRIPTION OF THE PREFERRED EMBODIMENTS

Figure 5A:
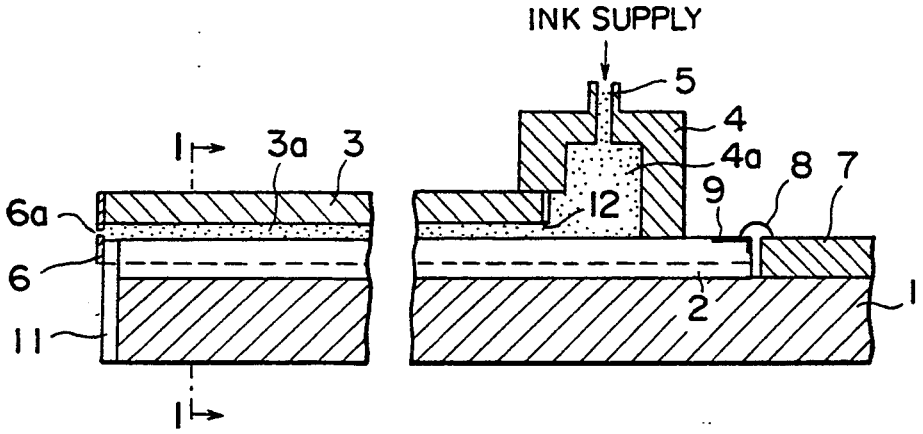
FIG. 5A is a view showing the construction of an ink jet printing head.
Figure 5B:
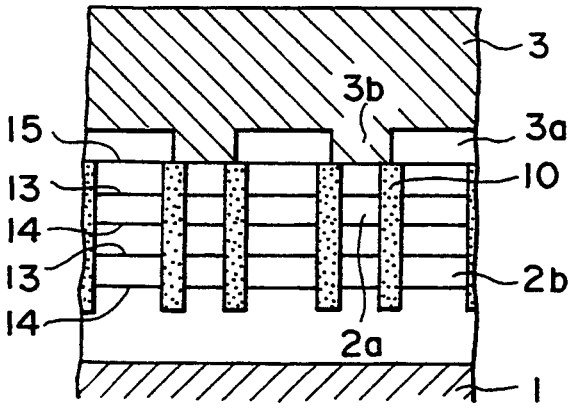
FIG. 5B is an enlarged sectional view of the printing head taken along a line 1—1 in FIG. 5A.

A description will now be given of a drop-on-demand ink jet printing head, with reference to FIGS. 5A and 5B. In FIG. 5A, this printing head includes a base 1, a multilayer piezoelectric member 2 provided on the base 1, a fluid passage plate 3 provided on the piezoelectric member 2, a common chamber member 4, and a nozzle plate 6. The fluid passage plate 3 has a plurality of fluid passages **3*a* separated from each other by wall portions 3*b*, each of the fluid passages 3*a* constituting a pressure chamber for discharging ink through a nozzle. The common chamber member 4 has a common chamber 4*a* communicating with each of the fluid passages 3*a*. The nozzle plate 6 has a plurality of nozzles 6*a* at the respective end portions of the fluid passages 3*a***.

The piezoelectric member 2 includes a plurality of non-driven piezoelectric elements **2*a* coupled to electrodes 13 and 14, and a plurality of piezoelectric elements 2*b* coupled to the electrodes 13 and 14. Each of the piezoelectric elements 2*b* is associated with respective of the nozzles 6*a* at the end portions of the fluid passages 3*a*. This piezoelectric member 2 is grooved so as to form a plurality of grooves 10 extending in a longitudinal direction of the fluid passages 3*a*. A suitable filler is inserted into the grooves 10. The fluid passage plate 3 is secured to the piezoelectric member 2 via an upper separator wall 15 on the member 2. In other words, the upper separator wall 15 is supported by the respective non-driven piezoelectric elements 2*a* and by the respective wall portions 3*b*. Each of the piezoelectric elements 2*b* has a width slightly smaller than a width of each of the fluid passages 3*a***.

The printing head also includes an ink supplying pipe 5 through which ink is fed into the common chamber **4*a*, a driving circuit 7 on a printed circuit board, a lead wire 8, a drive electrode 9 coupled to the driving circuit 7 via the lead wire 8, and a protective plate 11. A fluid resistance member 12 is provided at an intermediate portion between the fluid passage member 3 and the common chamber 4*a***.

The driving circuit 7 on the printed circuit board includes a drive signal generating circuit of the present invention, which will be described later. By means of the driving circuit 7, a signal having a predetermined voltage is applied to the piezoelectric elements **2*b* so that a predetermined capacity of each of the corresponding fluid passages is maintained. Practically, a number of the piezoelectric elements 2*b* of the printing head are selected depending on a print signal representing an image to be printed, and selected piezoelectric elements 2*b*** are driven for discharging ink on a recording member. For the sake of convenience, the following description will be given with respect to a selected piezoelectric element associated with a nozzle at an end of a fluid passage.

Figure 6A:
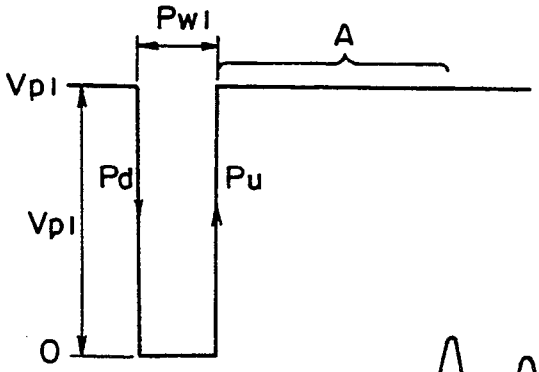
FIG. 6A is a diagram showing a waveform of a drive signal.

FIG. 6A shows a waveform of a drive signal applied to the printing head. Conventionally, when the printing head is driven, a pulse signal having a peak voltage amplitude Vp1 and a pulse width Pw1, shown in FIG. 6A, is applied to the piezoelectric element **2*b* of the printing head. When a voltage falling edge of the pulse signal indicated by "Pd" in FIG. 6A (from a pulse top at voltage Vp1 to a pulse base at voltage zero) is applied, the piezoelectric element 2*b* contracts the direction of the thickness so that a capacity of the fluid passage 3*a* is increased and ink is fed into the common chamber 4*a* through the ink supplying pipe 5 due to vacuum pressure produced therein. When a voltage rising edge of the pulse signal indicated by "Pu" in FIG. 6A (from a pulse base at voltage zero to a pulse top at voltage Pd1) is applied, the piezoelectric element 2*b* expands in the thickness direction so that the capacity of the passage 3*a* is reduced and the ink within the passage 3*a* is pressurized so as to discharge an ink droplet through the nozzle 6*a*. When the above mentioned pulse signal is applied to the piezoelectric element 2*b*** of the printing head, there is a problem in that the ink discharge velocity V has undesired variations if the drive signal frequency is varied, and that the variations of the ink discharge velocity V will degrade the print quality of image output by the printing head.

The reason why the ink discharge velocity V has undesired variations is that the ink in the fluid passage **3*a*** is subjected to oscillation resonant with a natural frequency of the printing head, and a pressure wave occurs due to the oscillation of the ink. The natural frequency of the printing head is determined primarily depending on the fluid passage dimensions, the material, the shape, the piezoelectric element elastic coefficient, the fluid viscosity, and the fluid mass.

Figure 6B:
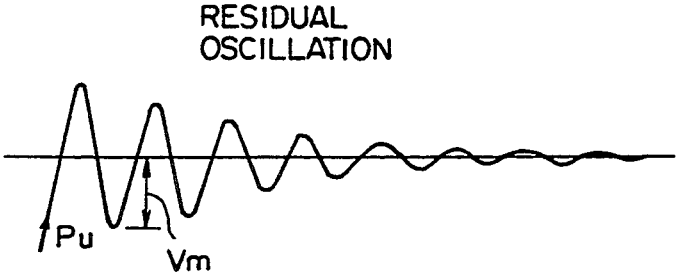
FIG. 6B is a diagram showing a residual oscillation due to the drive signal.

FIG. 6B shows a residual oscillation of the piezoelectric element **2*b* corresponding to a portion "A" of the drive signal indicated in FIG. 6A. This residual oscillation occurs to the piezoelectric element 2*b* after a voltage rising edge of the drive signal is applied. The reason why the residual oscillation occurs will now be described in more detail. After a voltage rising edge of the drive signal as indicated by Pu in FIG. 6B is applied to the piezoelectric element 2*b*, the ink in the fluid passage 3*a* is pressed and an ink droplet is discharged through the nozzle 6*a*. Immediately after the discharging, a pressure wave is generated in the ink in the fluid passage 3*a***, and the piezoelectric member 2 is pressed due to the pressure wave. A voltage signal is generated by the thus pressed piezoelectric element 2*b* and superimposed on the drive signal applied to the printing head, a residual oscillation thereby occurring to the piezoelectric element 2*b*. Apparently, the residual oscillation wave appearing at the portion A of in the drive signal is synchronous with the pressure wave generated in the ink in the fluid passage 3*a*.

Figure 3:
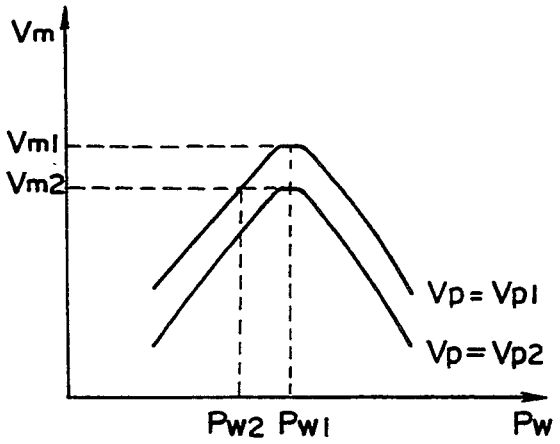
FIG. 3 is a diagram showing a relationship between residual oscillation amplitude, pulse width and peak voltage amplitude.

FIG. 3 shows a relationship between residual oscillation amplitude Vm, pulse width Pw, and peak voltage amplitude Vp. In FIG. 3, if the pulse signal has a constant peak voltage amplitude Vp1 and a constant pulse width Pw1, the residual oscillation amplitude Vm has the maximum value when the pulse width Pw of the residual oscillation wave is equal to Pw1. Thus, if the pulse width Pw is equal to the constant value Pw1, the residual oscillation amplitude Vm has the maximum value Vm1 when Vp=Vp1, and it has the maximum value Vm2 when Vp=Vp2. As shown in FIG. 3, the maximum value of the residual oscillation amplitude Vm is increased (Vm1>Vm2) if the peak voltage amplitude Vp of the pulse signal becomes greater. Generally, the greater the ink discharge velocity V is, the greater the maximum value of the residual oscillation amplitude Vm is. Therefore, if a relatively high discharge velocity is applied to the printing head, the residual oscillation amplitude has a relatively large value, and the ink discharge velocity V thus has great variations.

Figure 2A:
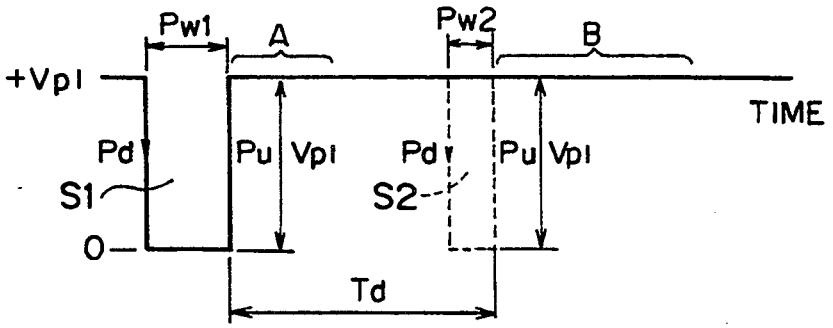
FIG. 2A is a diagram showing a waveform of a drive signal according to the present invention.
Figure 2B:
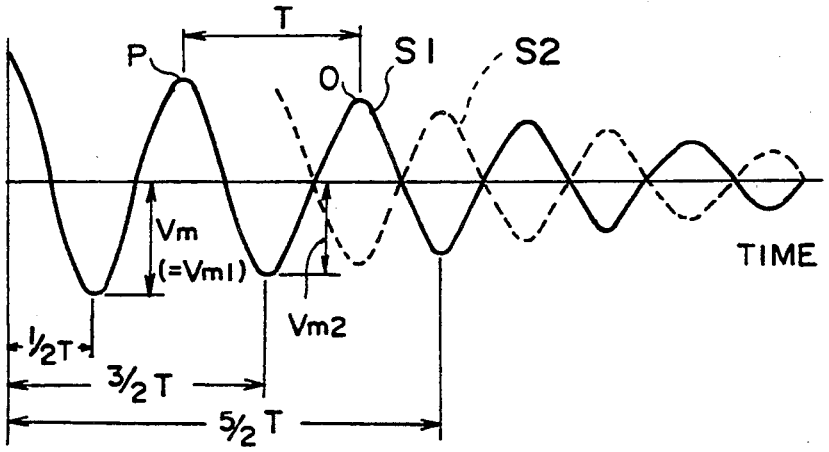
FIG. 2B is a diagram showing a residual oscillation wave due to the drive signal being applied.

FIGS. 2A and 2B show a waveform of the drive signal according to the present invention. In FIG. 2A, changes in voltage amplitude of the drive signal when it is applied to the printing head are represented in accordance with the elapsed time. In FIG. 2A, S1 indicates a first pulse signal which is a main drive signal applied to the printing head, and S2 indicates a second pulse signal, which is a compensation signal applied to the printing head, in order to compensate for an undesired influence on the printing head due to application of the main drive signal. The first pulse signal S1 is indicated by a solid line in FIG. 2A, and the second pulse signal S2 is indicated by a dotted line. FIG. 2B shows a waveform of a residual oscillation occurring to the piezoelectric element 2*b* due to the application of the first pulse signal S1, as indicated by a solid line in FIG. 2B (corresponding to a portion A of the signal S1 in FIG. 2A). FIG. 2B also shows a waveform of a residual oscillation due to the application of the second pulse signal S2, as indicated by a dotted line in FIG. 2B (corresponding to a portion B of the signal S2 in FIG. 2A).

The first pulse signal S1 of FIG. 2A is the same as the drive signal shown in FIG. 6A, the first pulse signal having a peak voltage amplitude Vp1 and a pulse width Pw1. As described above, after a voltage rising edge Pu of the first pulse signal S1 is applied, residual oscillation occurs to the piezoelectric element 2*b*. The residual oscillation is a damping oscillation as indicated in FIG. 2B. The second pulse signal S2 is applied after a prescribed delay time has elapsed (which delay time is preset to a value equal to an odd multiple of a half-period of the residual oscillation). The second pulse signal S2 of this embodiment has a peak voltage amplitude which is equal to the Vp1, and it has a second pulse width Pw2 which is smaller than the Pw1.

It is necessary to preset the pulse width of the second pulse signal S2 so as to produce a residual oscillation amplitude having the maximum value equal to Vm2. Since the peak voltage amplitude Vp of the second pulse signal S2 in this case is equal to Vp1, the relationship chart for when Vp=Vp1, as shown in FIG. 3, is referred to. According to the relationship chart (Vp=Vp1), the pulse width of the residual oscillation can be determined as Pw2, which pulse width corresponds to the value of the residual oscillation amplitude equal to Vm2 on the relationship chart. Thus, the pulse width of the second pulse signal S2 is preset to the value Pw2, so that residual oscillation is generated in the piezoelectric element 2*b*, due to the application of the second pulse signal S2, so as to effectively attenuate the residual oscillation due to the applied first pulse signal S1 effectively. Since the first and second pulse signals S1 and S2 have the value (Vp1) of the peak voltage amplitude that is equal to each other, the residual oscillations due to the applications of the first and second pulse signals will attenuate each other very effectively when the pulse width of the second pulse signal S2 is preset to Pw2.

In addition, it is necessary to preset a time delay Td between the voltage rising edge of the first pulse signal S1 and the voltage rising edge of the second pulse signal S2 in order that the preceding application of the second pulse signal S2 does not interrupt the discharge of the ink due to the following application of the first pulse signal S1. According to the present invention, the optimal value of the delay time Td is represented by the following formula:

$$Td=(3/2)\,T \qquad (1)$$

In this formula, T is a period of residual oscillation due to the application of a drive signal. According to this formula, the time delay Td of the present invention is preset to a value equal to a multiple of a half-period of the residual oscillation, the multiple being three. The residual oscillations due to the applications of the first and second pulse signals S1 and S2 will attenuate each other very effectively if the second pulse signal S2 is applied when the time delay Td according to the formula (1) has elapsed since application of the first pulse signal.

Figure 1:
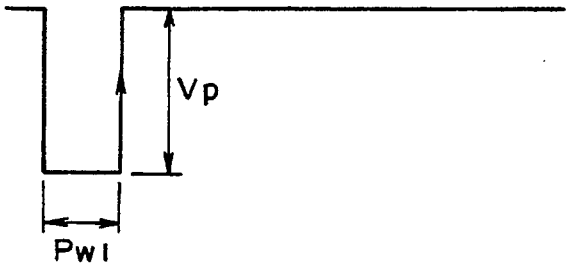
FIG. 1 A PRIOR ART
FIGS. 1A through 1C are diagrams for explaining an ink jet printing head driving method.
Figure 1:
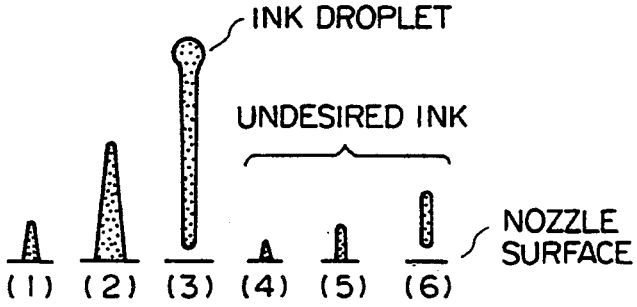
FIG. 1 B PRIOR ART
Figure 1:
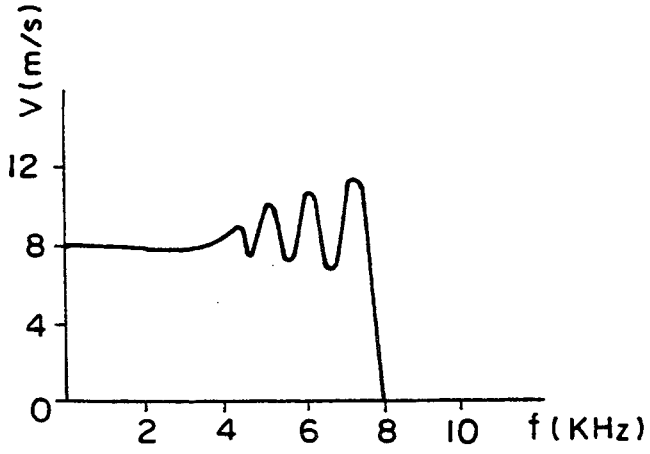
FIG. 1 C PRIOR ART
Figure 4A:
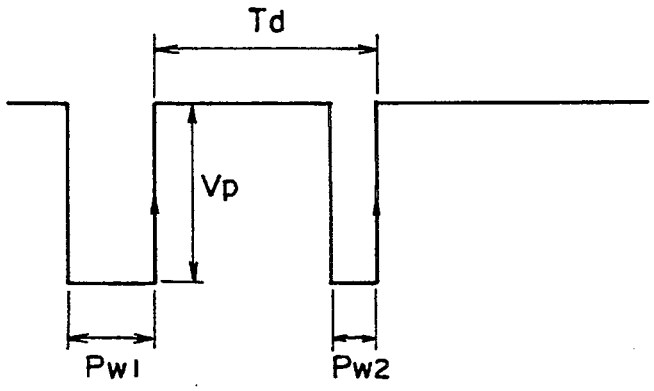
FIGS. 4A through 4C are diagrams for explaining a method of driving an ink jet printing head according to the present invention.
Figure 4B:
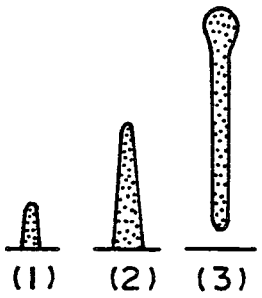
Figure 4C:
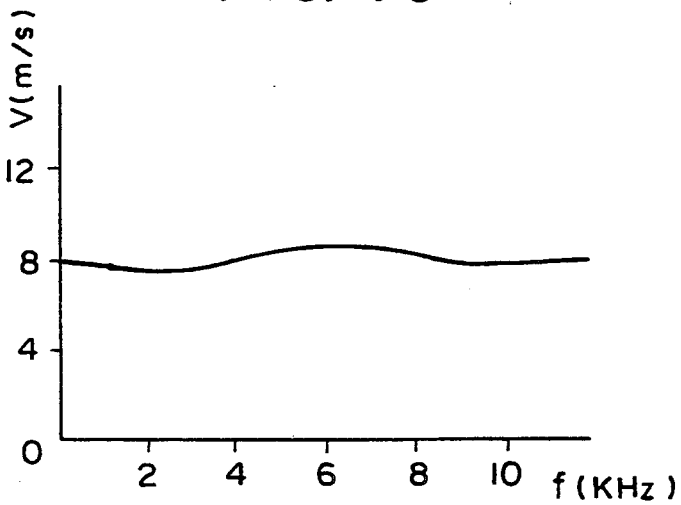

Next, a description will be given of a head driving procedure in which the printing head is driven and the ink is discharged through the nozzle. FIGS. 1A through 1C show a head driving procedure according to the prior art. FIGS. 4A through 4C show a head driving procedure according to the present invention.

FIG. 1A shows a waveform of the drive signal applied to the printing head in the conventional head driving procedure. This drive signal includes only a first pulse signal, and this signal has a peak voltage amplitude Vp of 22 volts and a pulse width Pw of 14 microsec. FIG. 1B shows the behavior of an ink droplet being discharged through the nozzle, in accordance with the elapsed time since the first pulse signal is applied. When the voltage rising edge of the first pulse signal is applied, the ink droplet is discharged as indicated in FIG. 1B (1) through (3). A residual oscillation occurs to the piezoelectric element 2*b* after the ink droplet is discharged, and an undesired ink droplet is further discharged due to the residual oscillation as indicated in FIG. 1B (4) through (6). There is a problem in that the undesired ink droplet degrades the image quality. FIG. 1C shows a characteristic chart indicating relationship between ink discharge velocity V and drive signal frequency f. As shown in FIG. 1C, the ink discharge velocity V in the conventional case has greater variations when the drive signal frequency f is increased, and the printing head is unable to discharge the ink when the drive signal frequency f is around 8 kHZ. This frequency shows the upper limit at which the ink discharge velocity can be maintained with the printing head in a stable operating condition.

FIG. 4A shows a waveform of the drive signal applied to the printing head according to the present invention. As described above, this drive signal includes the first pulse signal S1 and the second pulse signal S2, and there is a predetermined delay time Td between the voltage rising edge of the signal S1 and the voltage rising edge of the signal S2.

The first pulse signal of FIG. 4A has a peak voltage amplitude Vp of 22 volts and a pulse width Pw1 of 14 microsec., each of which is the same as the corresponding value of the conventional case (FIG. 1A) described above, for the sake of convenience. The second pulse signal of FIG. 4A has a pulse width Pw2 of 7 microsec., which is smaller than the above pulse width Pw1. The delay time Td is preset to a value equal to an odd multiple of a half-period of the residual oscillation, and, in this case, the Td is preset to a value equal to a multiple of a half-period of the residual oscillation, the multiple being three. If the period T of the residual oscillation is equal to 28 microsec., the delay time Td is preset to 42 microsec. (=(3/2)T) according to the formula (1). FIG. 4B shows the behavior of an ink droplet being discharged through the nozzle in accordance with the time elapsed since application of the first pulse signal. As shown in FIG. 4B, when the voltage rising edge of the first pulse signal S1 is applied, the ink droplet is discharged as indicated in FIG. 4B (1) through (3). No undesired ink droplet is discharged due to the application of the first pulse signal S1.

FIG. 4C shows a characteristic chart indicating relationship between ink discharge velocity V and drive signal frequency f according to the present invention. As shown in FIG. 4C, there are no great variations of the ink discharge velocity V even when the drive signal frequency f is increased, and the printing head is capable of discharging the ink in a stable operating condition when the drive signal frequency f is higher than 10 kHZ.

Next, a case in which the delay time Td equal to a half-period of the residual oscillation (Td=(½) T) is used, and a case in which the delay time Td equal to a multiple of the half-period of the residual oscillation, the multiple being 5, will be described. As described above, according to the present invention, the optimal value of the delay time Td is represented by the formula (1).

In the case of the delay time Td=(½) T being used, separation from the nozzle surface of an ink droplet having an elongated form (as shown in FIG. 4B (3)) is interrupted by the second pulse signal S2 being applied earlier than the discharge of the ink droplet. Thus, the following disadvantages appear in the head driving procedure.

1) The amount of ink ejected from the nozzle when the drive signal is applied is relatively small, and the efficiency of the printing head for discharging the ink becomes low.

2) The meniscus (or surface tension) of the ink in the fluid passage loses equilibrium and becomes unstable, and air is likely to enter the fluid passage, which is seriously detrimental to normal operation of the printing head.

In the case of the delay time Td=(5/2) T being used, the residual oscillation occurs to the piezoelectric element due to the application of the first pulse signal S1 before the second pulse signal S2 is applied. The following disadvantages appear in the head driving procedure.

1) An undesired ink droplet (as shown in FIG. 1B (4) through (6)) may be discharged at times corresponding to top peaks (which are indicated by P and Q in FIG. 2B and appear before the delay time Td=(5/2) T has elapsed) of the residual oscillation due to the application of the first pulse signal S1, which will degrade the quality of an image reproduced by the printing head.

2) A driving time duration, represented by the sum of the first pulse width Pw1 and the delay time Td, becomes longer. This is disadvantageous for achieving a high speed driving operation of the printing head.

In the above described embodiment, the second pulse signal S2 has a peak voltage amplitude equal to the Vp1, and it has a second pulse width Pw2 smaller than the Pw1. However, the present invention is not limited to this embodiment, and it is essentially important that the second pulse signal S2 produces the residual oscillation amplitude having a maximum value equal to the Vm2 after it is applied. Therefore, according to the characteristic chart shown in FIG. 3, it is possible to preset the second pulse signal S2 so as to have a pulse width equal to the Pw1 and a second peak voltage amplitude Vp2 lower than the Vp1. If the second pulse signal S2 is preset in this manner, the same functions and effects of the present invention can be achieved.

Figure 7A:
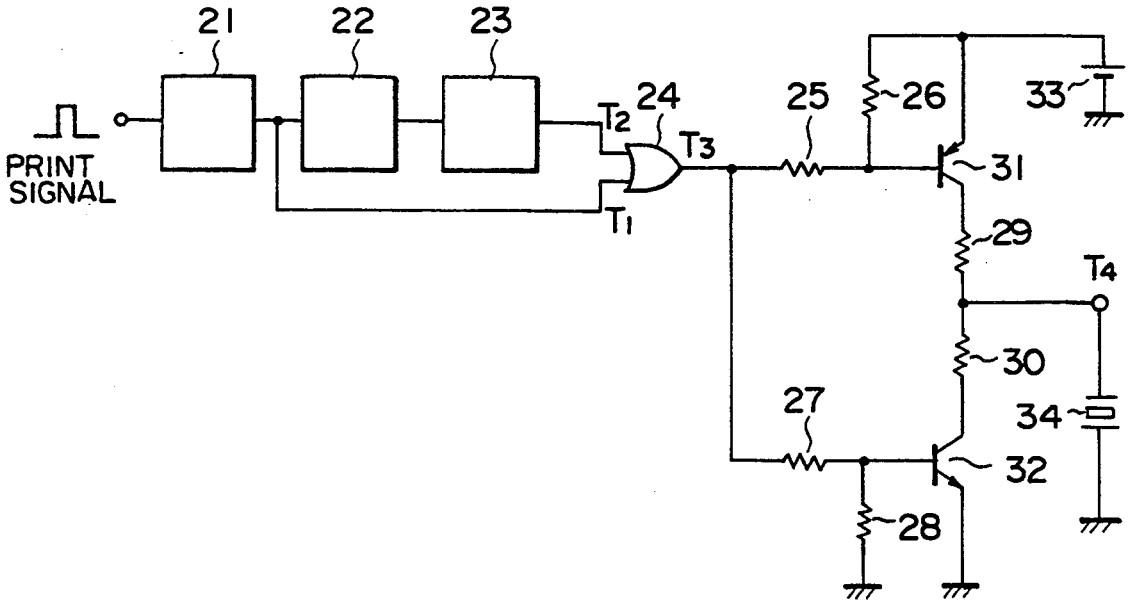
FIG. 7A is a diagram showing a drive signal generating circuit for outputting a first pulse signal and a second pulse signal.
Figure 7B:
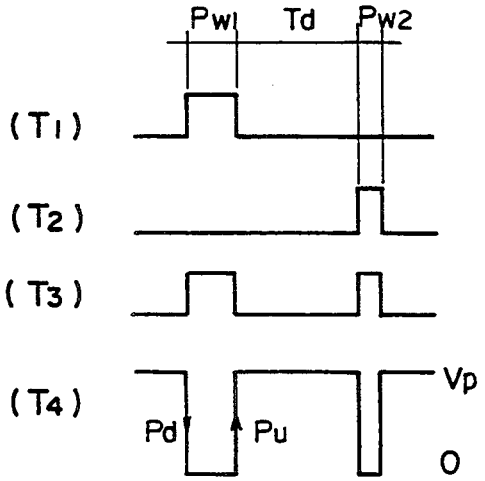
FIG. 7B is a time chart showing pulse signals output by the circuit of FIG. 7A.

Next, a description will be given of a drive signal generating circuit for applying the first and second pulse signals to the printing head in an appropriate manner, with reference to FIGS. 7A and 7B. FIG. 7A shows an example of the drive signal generating circuit; this circuit may be built in an integrated circuit (IC). In FIG. 7A, this drive signal generating circuit includes three monostable multivibrators 21, 22 and 23; an OR circuit 24; six resistors 25 through 30; a PNP transistor 31; an NPN transistor 32; a power supply 33; and a piezoelectric element 34. Practically, a plurality of piezoelectric elements are provided within the printing head, and some of them are selected depending on a print signal being input to this drive signal generating circuit. When a drive signal is received from the drive signal generating circuit, the selected piezoelectric elements are activated for discharging the ink via the nozzle. For the sake of convenience, the following description will be given with respect to a selected piezoelectric element.

In the circuit shown in FIG. 7A, a print signal representing an image to be printed is input to the monostable multivibrator 21. After the print signal is received, the monostable multivibrator 21 outputs a pulse signal having a first pulse width Pw1 to an input terminal T1 of the OR circuit 24. This pulse signal (T1) is shown in FIG. 7B. This pulse signal is also output to the two monostable multivibrators 22 and 23 connected in series. After the pulse signal is received, the monostable multivibrator 23 outputs a pulse signal having a second pulse width Pw2 to the other input terminal T2 of the OR circuit 24. There is a time difference between the pulse signal (T1) and the pulse signal (T2) as shown in FIG. 7B, and this time difference is the delay time Td described above. The OR circuit 24 outputs a signal (T3) representing the sum of the two pulse signals (T1) and (T2). This signal (T3) is shown in FIG. 7B.

The NPN transistor 32 is normally switched OFF. A source voltage Vp is always applied by the power supply 33 to the piezoelectric element 34 via the PNP transistor 31 and the resistor 29. When the signal (T3), output by the OR circuit 24 and having positive voltage amplitude, is applied to a base of the PNP transistor 31 via the resistor 25 and applied to a base of the NPN transistor 32 via the resistor 27, the NPN transistor 32 is switched ON and the PNP transistor 31 is switched OFF. A drive signal to be applied to the printing head thus appears at a terminal T4 of the piezoelectric element 34, and this drive signal (T4) includes the first pulse signal S1 having the peak voltage amplitude Vp with the first pulse width Pw1, and the second pulse signal S2 having the delay time Td with the second pulse width Pw2, as shown in FIG. 7B.

When the voltage falling edge of the first pulse signal is applied, the piezoelectric element 34 is subjected to discharging via the resistor 30. When the voltage rising edge of the first pulse signal is applied, the piezoelectric element 34 is subjected to charging via the resistor 29. Thus, the discharging time and the charging time of the piezoelectric element 34 can be adjusted by changing a value of resistance of the resistors 30 and 29.

Further, the present invention is not limited to the above described embodiments, and variations and modifications may be made without departing from the scope of the present invention.

What is claimed is:

1. A method of driving an ink jet printing head for ink jet recording of image data, said method comprising the steps of:

providing an ink jet printing head including a plurality of transversely spaced parallel liquid passages having a plurality of discharge ports for discharging ink therethrough, ink supplying means for supplying ink to each of said liquid passages, and piezoelectric means associated with each of said discharge ports for discharging ink when said associated piezoelectric means is driven, and a prescribed source voltage being constantly applied to said piezoelectric means to maintain a capacity of each of said liquid passages at a predetermined level;

applying a voltage falling edge of a first pulse signal to cause said associated piezoelectric means vertically contract so that the capacity of a corresponding liquid passage is increased from said predetermined level so as to supply ink from said ink supplying means to said corresponding liquid passage;

applying a voltage rising edge of the first pulse signal to cause said associated piezoelectric means to vertically expand so that the capacity of the corresponding liquid passage is decreased, for discharging an ink droplet through a corresponding discharge port, said first pulse signal having a first pulse width between said falling edge and said voltage rising edge and having a first peak voltage amplitude; and applying a voltage rising edge of a second pulse signal to said associated piezoelectric means after a predetermined delay time has elapsed since application of said voltage rising edge of said first pulse signal for discharging the ink droplet, a pulse width of said second pulse signal between a voltage falling edge thereof and said voltage rising edge being smaller than said first pulse width, and a peak voltage amplitude of said second pulse signal being equal to said first peak voltage amplitude, wherein said predetermined delay time is set to a value equal to a multiple of a half-period of a residual oscillation, the multiple being three, said residual oscillation occurring to said piezoelectric means due to application of the first pulse signal.

2. A method according to claim 1, wherein said steps of applying said first and second pulse signals are sequentially repeated by said ink jet printing head in accordance with a print signal representing an image to be printed.

3. A method according to claim 1, wherein said first pulse signal and said second pulse signal are applied in a manner such that a residual oscillation occurring due to the application of the first pulse signal and a residual oscillation occurring due to the application of the second pulse signal have substantially the same amplitude, in addition to said predetermined delay time, so as to attenuate each other.

4. A method of driving an ink jet printing head for ink jet recording of image data, said method comprising the steps of:

providing an ink jet printing head including a plurality of transversely spaced parallel liquid passages having a plurality of discharge ports for discharging ink therethrough, ink supplying means for supplying ink to each of and liquid passages, said piezoelectric means associated with each of said discharge ports for discharging ink when said associated piezoelectric means is driven, and a prescribed source voltage being constantly applied to said piezoelectric means to maintain a capacity of each of said liquid passages at a predetermined level;

applying a voltage falling edge of a first pulse signal to cause said associated piezoelectric means to vertically contract so that the capacity of a corresponding liquid passage is increased from said predetermined level and ink is supplied to said corresponding liquid passage;

applying a voltage rising edge of the first pulse signal to cause said associated piezoelectric means to vertically expand so that the capacity of the corresponding liquid passage is decreased, for discharging an ink droplet through a corresponding discharge port, the first impulse signal having a first pulse width between said voltage falling edge and said voltage rising edge and having a first peak voltage amplitude; and applying a voltage rising edge of a second pulse signal to said associated piezoelectric means after a predetermine delay time has elapsed since application of said voltage rising edge of said first pulse signal for discharging the ink droplet, said second pulse signal having a pulse width equal to said first pulse width and having a peak voltage amplitude smaller than said first peak voltage amplitude, wherein said predetermined delay time is set to a value equal to a multiple of a half-period of a residual oscillation, the multiple being three, said residual oscillation occurring to said piezoelectric means due to application of the first pulse signal.

5. A method according to claim 4, wherein said steps of said pulse signal applications are sequentially repeated by said ink jet printing head in accordance with a print signal representing an image to be printed.

6. A method according to claim 4, wherein said first pulse signal and said second pulse signal are applied in a manner such that residual oscillation occurring due to the application of the first pulse signal and residual oscillation occurring due to the application of the second pulse signal have substantially the same amplitude, in addition to said predetermined delay time, so as to attenuate each other.

* * * * *